US006331145B1

(12) United States Patent
Sity et al.

(10) Patent No.: US 6,331,145 B1
(45) Date of Patent: Dec. 18, 2001

(54) ELECTRONIC DICE

(75) Inventors: Refael Sity, Kfar Saba; Joshua Bronfeld, Mobile Post Mercaz, both of (IL)

(73) Assignee: Cibro Technologies Ltd., Jerusalem (IL)

( * ) Notice: Subject to any disclaimer, the term of this patent is extended or adjusted under 35 U.S.C. 154(b) by 0 days.

(21) Appl. No.: 09/486,373

(22) PCT Filed: Aug. 24, 1998

(86) PCT No.: PCT/IL98/00404

§ 371 Date: Feb. 28, 2000

§ 102(e) Date: Feb. 28, 2000

(87) PCT Pub. No.: WO99/11344

PCT Pub. Date: Mar. 11, 1999

(30) Foreign Application Priority Data

Aug. 31, 1997 (IL) ..... 121666

(51) Int. Cl.[7] ..... A63F 9/24

(52) U.S. Cl. ..... 463/22; 273/146; 273/138.2

(58) Field of Search ..... 463/22, 19, 18, 463/31, 17, 29, 25, 20, 42, 40, 10, 13, 12, 11; 273/138.2, 143 R, 148 R, 269, 142 B, 142 E, 142 R, 118 A, 119 A, 123 A, 237, 139, 274

(56) References Cited

U.S. PATENT DOCUMENTS 2,881,892 * 4/1959 Ylinen .
3,459,427 * 8/1969 Rhodes .
3,592,473 * 7/1971 Jernakoff .
3,659,853 * 5/1972 Church .
3,791,650 * 2/1974 Dice .
4,034,988 * 7/1977 Goldner et al. .
4,124,881 * 11/1978 Haber et al. .
4,148,488 * 4/1979 Kohlhagen .
4,181,304 * 1/1980 Haber .
4,431,189 * 2/1984 Wiencek et al. .
4,506,890 * 3/1985 Murry .
4,641,840 * 2/1987 Larson .
4,669,728 * 6/1987 Carden .
4,858,931 * 8/1989 McKechnie .
4,909,513 * 3/1990 Kiyono .
5,031,914 * 7/1991 Rosenthal .
5,166,502 11/1992 Rendelman et al. .
5,263,715 * 11/1993 Matsumoto et al. .
5,344,145 * 9/1994 Chadwick et al. .
5,651,548 7/1997 French et al. .
5,885,157 * 3/1999 Harada et al. .

* cited by examiner

*Primary Examiner*—Michael O'Neill
(74) *Attorney, Agent, or Firm*—Eitan, Pearl, Latzer & Cohen-Zedek

(57) ABSTRACT

An object (10) having n faces, includes wireless transmitting means (12) for transmitting the value of at least the face of the object lying on a surface. In one embodiment, the face of the object (10) has n faces, includes at least n−1 sensors (S) installed therein, a controller (27, 101) coupled to each of the n−1 sensors (S) and a wireless transmitter device (12) coupled to the controller unit (27, 101) for transmitting data from each of the n−1 sensors (S).

40 Claims, 8 Drawing Sheets

ELECTRONIC DICE

FIELD OF THE INVENTION

The present invention relates to computer and board games in general and in particular to such games using one or more dice.

BACKGROUND OF THE INVENTION

It is very well known to use one or more dice in games, such as backgammon and especially in board games such as 'snakes and ladders' and 'monopoly'. In recent years, many of these games have been adapted for use with the computer. In the computer version of these games, the computer acts as the dice thrower and effectively takes control of that particular aspect of the game. In other words the player of the game presses a button, a key, or his mouse in order to intiate the action of the dice throwing. The player, who does not have any physical control over the action of the dice, is prevented from determining the outcome of the dice throw. Consequently, the computer versions of games are less exciting since they lack an important element of the game, the 'feel' and control over the dice throw.

Dice are also an integral part of certain gambling games such as craps, where the throwing of the dice and the resulting fall of the dice are the critically important constituents of the game.

SUMMARY OF THE INVENTION

An object of the present invention is to provide a computerized system for games and other software applications using dice which overcomes the disadvantages of prior systems.

It is a further object of the present invention to provide an electronic dice which allows the player to control the action of the dice while the result of the throw is communicated to a computer or other electronic device. The electronic device can include a device which converts the transmitted result to an audio output for indicating the result. The audio output is especally useful for blind persons. The device can also be used with games and "video-type" games played on a television.

It is a still further object of the present invention to provide a device, which can be used as a means to prevent software piracy.

It is a still further object of the present invention to provide a device, which can be used as an integral component of one or more software applications.

There is thus provided, in accordance with a preferred embodiment of the present invention, an object having n faces, includes wireless transmitting means for transmitting the value of at least the face of the object lying on a surface.

Additionally, there is provided, in accordance with a preferred embodiment of the present invention, an object having n faces, includes at least n−1 sensors, each of n−1 faces of the object having one of the n−1 sensors installed therein, controller coupled to each of the n−1 sensors and a wireless transmitter device coupled to the controller for transmitting data from each of the n−1 sensors.

Additionally, there is also provided, in accordance with a preferred embodiment of the present invention, an object having n faces, includes at least n−1 transponders, each of n−1 faces of the object having one of the at least n−1 transponders installed therein for transmitting data from each of the n−1 faces.

In addition, there is also provided, in accorance wnth a preferred embodiment of the present invention, a system for communicating with an object The system includes at least one transponder installed in the object, for transmitting data from the object, a read/write unit for receiving the transmitted data, and a processing unit coupled to the read/write unit, for processing the data.

The controller includes one of a group of devices including a register, processor, buffer, control logic and microcontroller. The wireless transmitter device includes one of a group of devices including an infra-red, transmitter and a RF transmitter, ultra sonic.

Furthermore, in accordance with a preferred embodiment of the present invention, the read/write unit includes a base station transceiver hating an antenna attached thereto, a microcontroller coupled to the base station transceiver.

Furthermore, in accordance with a preferred embodiment of the present invention, the processing unit is coupled to the read/write unit by any of the following group including serial RS232, parallel, USB (Universal serial Bus) and SCSI (small computer system interface) or keyboard interface.

In addition, in accordance with a preferred embodiment of the present invention, the system according further includes a surface for throwing the object thereon. The surface includes sealing means used with a dice having optical sensors to prevent light from reaching the face of the object in contact with the surface. The surface may be composed of a metallic material used wth a dice having a transponder.

Furthermore, in accordance with a preferred embodiment of the present invention, the system also can include a CCD (charge coupled camera) for imaging at least one face of the object.

Furthermore, in accordance with a preferred embodiment of the present invention, the transponder includes a radio frequency (RF) transceiver, electrically erasable programmable read-only memory (EEPROM) storage means coupled to the radio frequency transceiver, and an a controller, The controller is connected to the memory means and the RF transceiver. The EEPROM storage means includes an ID code and/or encrypted data stored therein.

Altnatively the transponder includes radio frequency (RF) transceiver and electrically erasable programnable read-only memory (EEPROM) storage means coupled to a microcontroller.

In addition, in accordance with a preferred embodiment of the present invention, the object includes an input register coupled to the RF transceiver for latching the signals being transmitted by each of the at least n−1 sensors at predetermined intervals.

The electrical components of the objects receive their operating energy from either a remote read/write unit, solar cells, drycell batteries, or photo-voltaic cells coupled thereto. The sensors include photodiode, photo-transistor sensors, capacitance sensor or induction coil and mechanical sensors.

In addition, in accordance with a preferred embodiment of the present invention, there is also provided a software piracy protection system which includes at least one object, having an ID code encrypted therein and including a transponder, and a read/write unit for vernfying the authenticity of the encrypted ID code for each of the at least one object.

Furthermore, in accordance with a preferred embodiment of the present invention, the object includes additional ID codes encrypted in the transponder, each of the ID codes being related to a separate software application. Altematively, the object includes a single ID code which is related to a specific software application.

In addition, in accordance wfth a preferred embodiment of the present invention, there is also provided apparatus for use with a software driven application. The apparatus includes at least one object, having an ID code encrypted therein and including a wireless transceiver, and a software application for verifying the authenticity of the encrypted ID code of the object in order to run a software application. Furthernore, the object may be an integral component of the software application.

In addition, a method for indicating the value of the uppermost face of an n-sided object laying on a surface is provided. The method includes the steps of:

the object transmitting data from at least the uppermost or lowermost face of the object; and processing the data.

The object includes an ID code encrypted therein and a wireless transceiver and further includes the step of the transceiver transmitting a coded identification signal to the object to decrypt the encrypted ID code.

Finally, a method for indicating the value of an object thrown onto a playing surface is provided, in accordance with a preferred embodiment of the present invention. The object includes an ID code encrypted therein and a wireless transceiver. The method includes the steps of;

a) the object transmitting the value of at least n−1 of its faces;

b) a read/write unit receiving the transmitted data; and c) processing the data to determine the value of the uppermost face of the object.

Finally, there is provided a method for protecting a plurality of software applications running in a multi-tasking environment, the method includes:

storing data associated with each of the plurality of software applications in each of a plurality of objects;

transmitting the data from each of the plurality of objects to the multi-tasking environment; and verifying the authenticity of the transmitted data in order to run each of the plurality of software applications.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
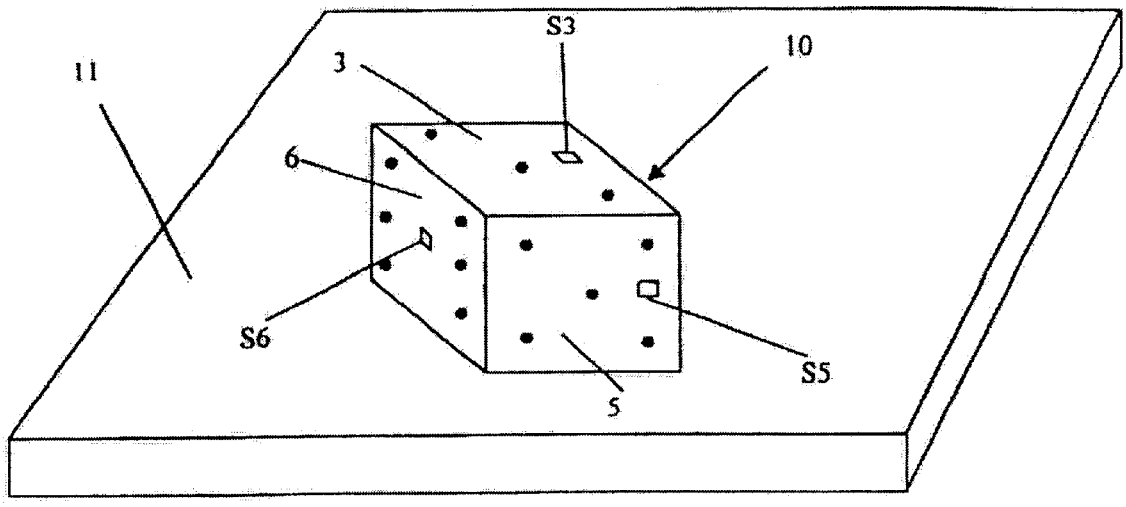
FIG. 1 is a schematic illustration of an electronic dice, according to a preferred embodiment of the present invention.
Figure 2:
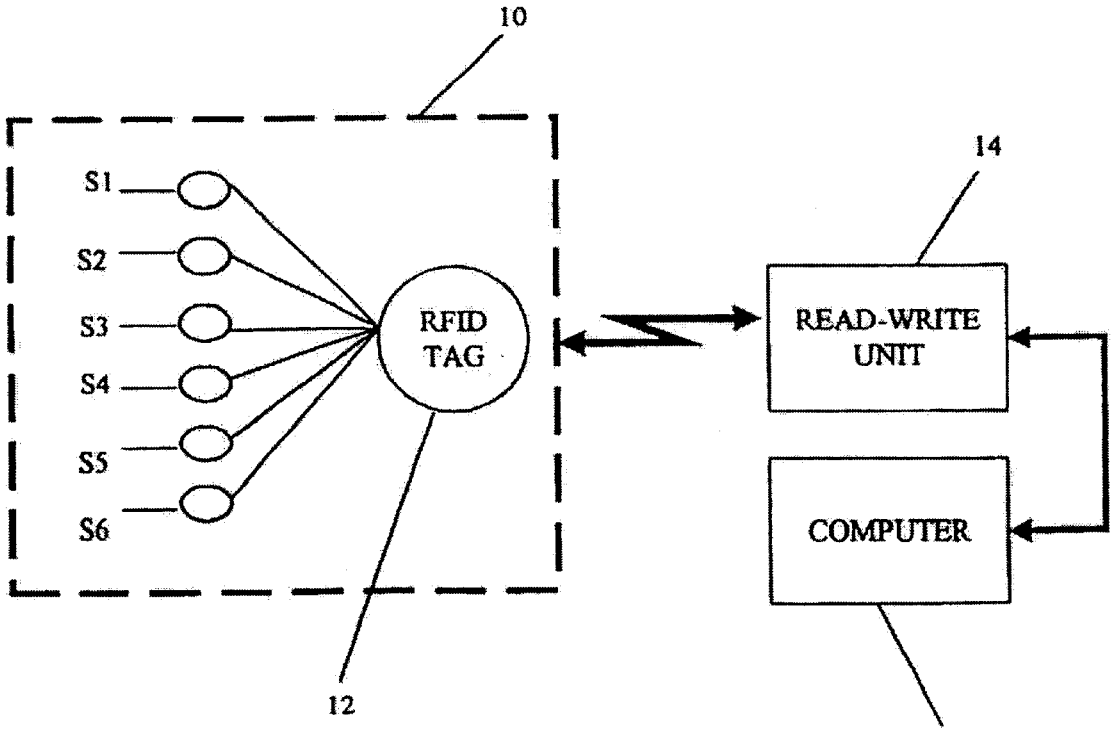
FIG. 2 is a block diagram illustration of a computerized system utilizing the electronic dice of FIG. 1.

Reference is now made to FIGS. 1 and 2. FIG. 1 is a schematic illustration of an electronic dice 10, according to a preferred embodiment of the present invention. Electronic dice 10 is configured, in the example of FIG. 1, to look like a standard dice having six faces, numbered form 1 to 6. In FIG. 1, three faces, numbered 3, 5 and 6, are visible and one face (opposite "3"), is lying face down on a surface 11. Each face of the dice 10 comprises a sensor, generally designated S and individually referenced S1, S2, S3. S4, S5 and S6, corresponding to each of the numbers one to six respectively. As best seen in FIG. 2, dice 10 further comprises a wireless transmitter device such as an RFID (Radio Frequency Identification) transponder (or tag) 12 vwhich is in wireless communication with a read/write unit 14 coupled to a computer 16.

The RFID tag 12 receives signals from each of the sensors S via a controller (not shown) which it can then transmit to read/write unit 14. The computer 16 processes the signals received by read/write unit 14 in order to identify the face next to the surface 11 and thus, its uppermost face ("3" in the example of FIG. 1).

The connection between the readarite unit 14 and the electronic dice 10 is by means of a wireless communication such as, radio frequency (RF), infrared or any other suitable cordless communication.

In one preferred embodiment, electronic dice 10 comprises a plurality of sensors S which are coupled to a RFID tag 12. It is a feature of electronic dice 10 that RFID tag 12 is capable of receiving data from each of the sensors S1 . . . S6 built into each face of the dice 10 and furthermore can communicate the position of the dice 10 to the computer 16.

It will be appreciated that the present invention is not limited to a six-sided dice, but is applicable to any object having at least two faces.

The purpose of the sensors S is to determine the face upon which the dice falls. Since one face of the dice 10 is always obscured (five faces always being visible), by analyzing the signals received from each of the sensors S1 . . . S6, it is possible to determine which face is face down (obscured) and thus which face is uppermost.

Any suitable type of sensor may be used, the type of sensor being selected depending upon the particular implementation. Sensors S include, but are not limited to, induction coil sensors, capacitance sensor, mechanical and optical sensors.

In a preferred embodiment of the invention a plurality of optical sensors (S1, S2, . . . S6), one in each face is used. Optical sensors S include but are not limited to photodiode and photo-transistor sensors such as the model OD44L photodiode manufactured by the OKI Company of Japan. When a dice has been thrown onto a playing surface (board), for example, one of its faces will be face down and will be transmitting a "0" signal. In other words, the 'obscured' face will be generating a 'dark' current, equivalent to logic value of "0". In contrast, all the other faces will generate a 'light' current, hat a logic value of "1". The face lying closest to the board is thus known and by analysis it is possible to determine the uppermost face of the dice. The type of board (playing surface) to be used with optical sensors is one which totally seals off the light from the bottom face so as prevent the optical sensor in the bottom face from emitting a signal.

The controller may be any suitable device known in the art such as a register, processor, buffer and micro-controller.

In an alternative embodiment, a RFID transponder, preferably anti-collision to prevent interference between signals, is located in each of the faces of the dice may be used together with a metal playing surface. The face of the dice falling onto the metal surface will not able to transmit a signal. All the other five faces of the dice will be transmitting a signal and, on the basis of elimination, it will be possible to identify the uppermost face.

Any suitable type of commercially available, anti-collision, RFID transponder may be used such as the Hitag™ HT1 transponder manufactured by Mikron Gmbh. of Gratkom, Austria.

It will be appreciated by persons skilled in the art that it is not essential that an optical sensor or, in the alternative embodiment, a RFID tag be located in each face of the dice in order to determine the value of the non-transmitting face. For a dice having n faces, a minimum of n−1 sensors need to be installed. This can be demonstrated by the example of a dice having 6 (n) faces and 5 (n−1) sensors. Should, the dice land on the face not having a sensor, five sensor will be transmtting data and by elimination, the non-transmitting face is thus next to the playing surface. Should, the dice land on one of the faces having a sensor, only four sensors will tansnit data. In this case, the non-transmitting sensor identifies the face next to the playing surface.

In the preferred embodiment of the invention, dice 10 is a 'passive' dice using RF transmissions to receive its energy source. In contrast to an "active" dice which contains is own source of power, such as a battery, the 'passive' dice receives its operating energy from a remote energy source. A description of the transmission of energy to RFID tag 12 will be described hereinbelow.

Figure 3A:
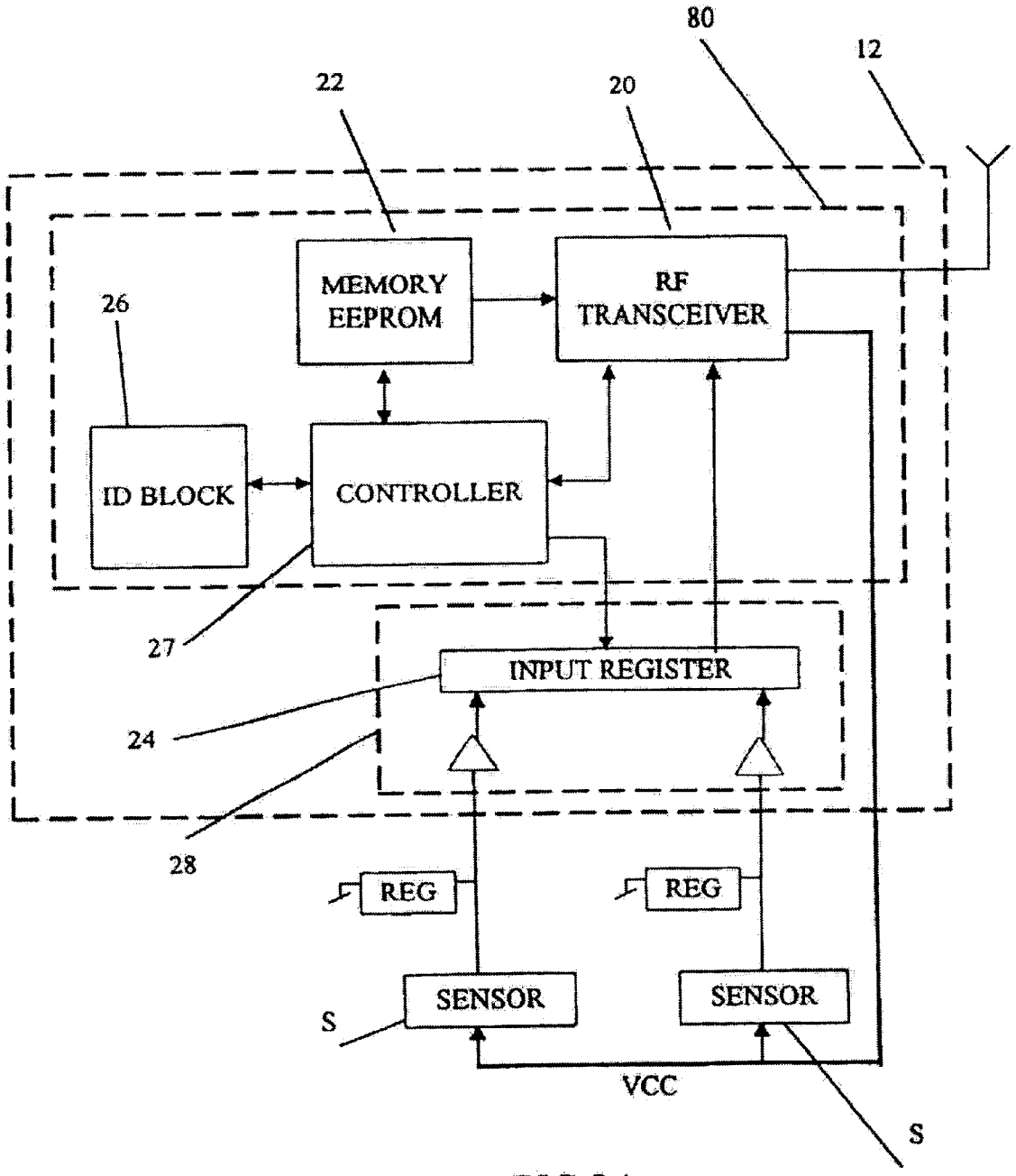
FIGS. 3A and 3B are schematic block diagram illustrations of the RFID tag used within the dice of FIG. 1.
Figure 3B:
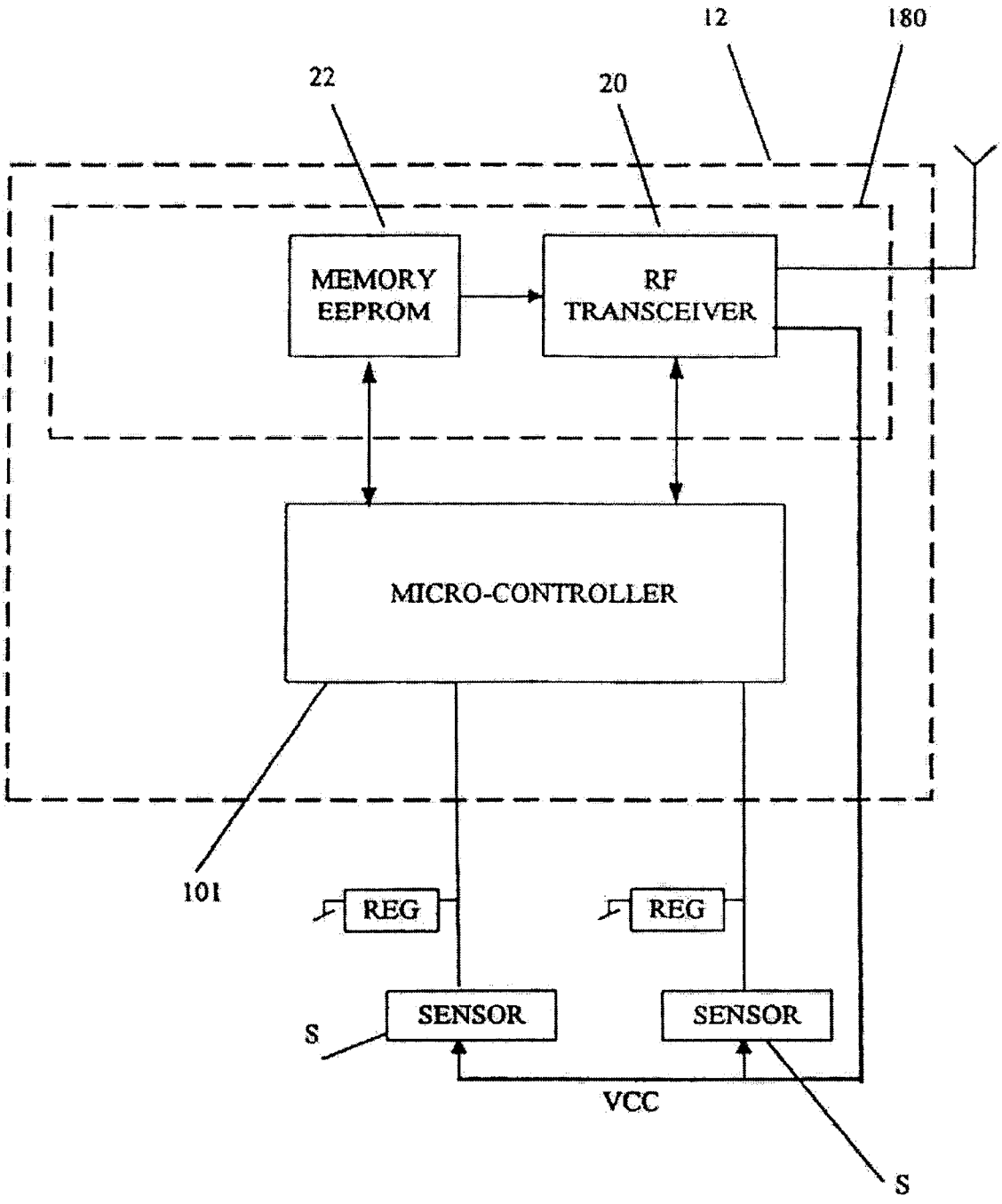

Reference is now made to FIGS. 3A and 3B which are block diagram illustrations of alternative embodiments of RFID tag 12.

Reference is now made to FIGS. 3A and 3B which are block diagram illustration of the RFID tag 12. RFID tag 12 comprises a read/write tag 80 comprising commerically available components including an RF transceiver 20 having memory storage means 22, such as EEPROM connected thereto. RFID tag 12 further comprises an ID block 26 connected to a controller 27. Controller 27 is also connected to memory means 22 and RF transceiver 20.

RFID transponder 80 is any suitable commercially available tag, such as the TEMIC semiconductor e5550, manufactured by Temic Telefunken Microelectronic Gmbh of Heilbronn, Germany.

Memory storage means 22 is preferably an EEPROM (electrically erasable programmable read-only memory) chip configured to store an unique identification (ID code) for each RFID tag enabling more than one dice to be used in a system. In addition, other encrypted data can also be stored in the EEPROM 22.

RFID tag 12 further comprises an input register 24 which is coupled to RF transceiver 20 and controlled by controller 27.

The sensors S are coupled to input register 24 which latches the signals being transmitted by the sensors S at regular pre-detennined intervals, for example, every 0.05 msecs. Each of the sensors (S1 . . . S6), as well as the RF tag, receive their operating energy (VCC) from RF transceiver 20.

ID block compares and checks the signal code received by the RF transceiver 20 from read/write unit 14. The contents of the dice 10 (input register 24 and EEPROM 22) are only transmitted if the codes match the ID data stored in EEPROM 22.

It is a further feature of the present invention to use an ID code which protects the electronic dice from being illegally copied. Each RFID tag within the dice is configured with its own ID code which is compared with a code transmitted by the computer. Thus, it is possible to check the legality or originality of the particular electronic dice and whether the game, or software application using the dice, is a copy or an original. In other words, the ID code acts to prevent fraudulent copying of dice 10, and the game or application using the dice.

Since a standard transponder (tag) does not have its own energy source, in order for RFID tag 12 to transmit or receive data to read/write unit 14, it requires energy frm an external source. In the preferred embodiment of the invention, the dice 10 receives its operating energy via electromagnetic waves transmitted by read/write unit 14 via a transceiver 32 (see FIG. 4 hereinbelow).

Thus, dice 10 does not require its own energy source. Instead, it receives its energy directly from the read/write unit 14. Using the energy supplied by the read/write unit 14 to the sensors S, the RFID tag 12 transmits the status of the dice 10 to the computer 16. An advantage of a passive dice is that it is not necessary to replace ten battery (or other energy source) within the dice.

In an alternative embodiment, energy may be supplied to the dice 10 by means of solar cells, drycell batteries, photo-voltaic cells or similar.

In the alternative embodiment illustrated in FIG. 3B, the transponder interface 180 (which performs functions similar to tag transponder 80 of FIG. 3A) comprises an RF transceiver 20 having memory storage means 22, such as EEPROM connected thereto. RFID tag 12 is similar to FIG. 3A except that the RFlD tag comprises a micro-controller 101 (instead of input register 24 controller 27, and ID block 26 of FIG. 3A) which is coupled to RF transceiver 20.

Figure 4:
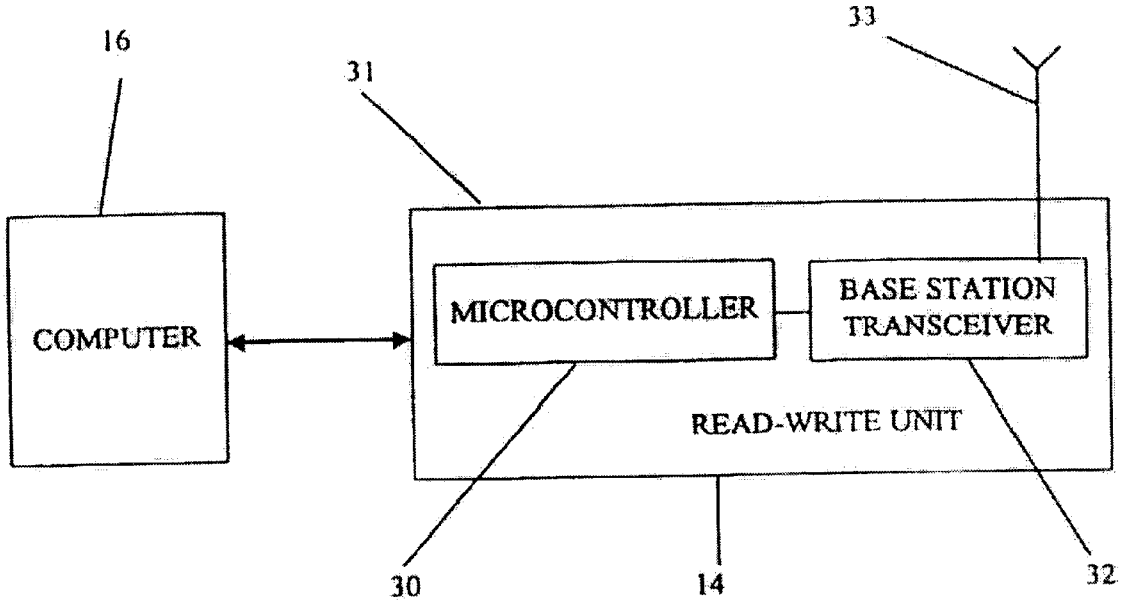
FIG. 4 is a schematic blck diagram illustration of the transceiver coupled to a computer of the system of FIG. 2.

The sensors S are coupled to micro-controller 101 which latches the signals being transmitted by the sensors S at regular pre-determined intervals, as described hereinabove with respect to FIG. 3A. The functions of ID block 26 and controller 27 are carried out by micro-controller 101. Reference is now made to FIG. 4 which is a block diagram illustation of the read/write unit 14 coupled to computer 16.

Read/write unit 14 comprises a microcontroller 30 or control logic coupled to a base station transceiver 32 having an antenna 33 attached thereto. The station transceiver 32 is any suitable commercially available transceiver, such as model U2270B manufactured by Temic Telefunken Microelectronic Gmbh of Heilbronn, Germany.

Read/write unit 14 is preferably also coupled to the computer by any suitable means, such as serial RS232 or parallel, USB (Universal serial Bus), SCSI (small computer system interface) or keyboard interface, for example.

It will be appreciated by persons knowledgeable in the art, that the type of read/write unit 14 utilized will be deternined by the type of dice and the method of transmission. For instance, as in the preferred embodiment, the dice and the read/write unit 14 will be based on a similar RFID technology. Similarly, if the dice uses infra-red technology for transmission then the read/write unit 14 will of course be configured to receive infra-red technology.

A system utilizing the electronic dice 10 is described with reference to the flow charts of FIGS. 5A–5D, which describe the operational steps of a sample calling application 200.

Figure 5A:
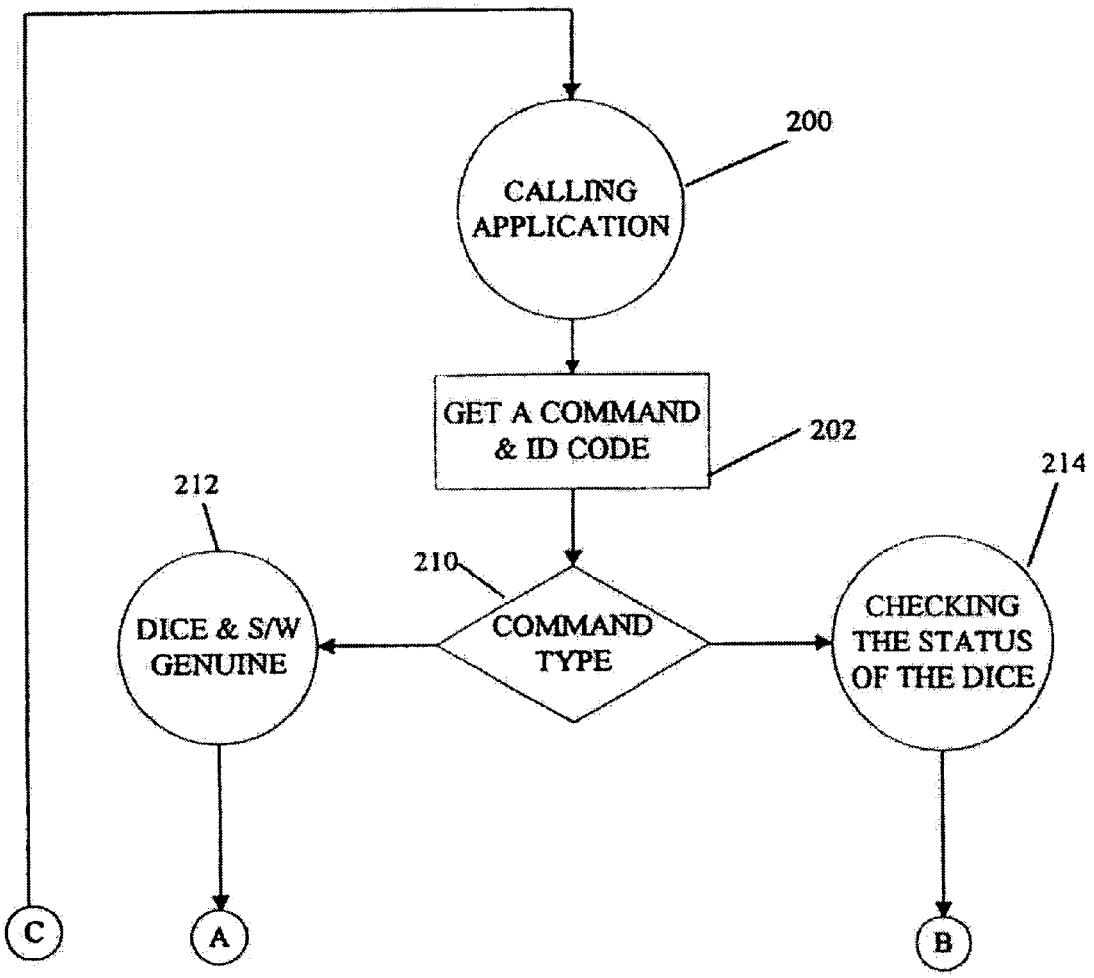
FIGS. 5A–5D are flow chart illustration of the operation of the system of FIG. 2.
Figure 5B:
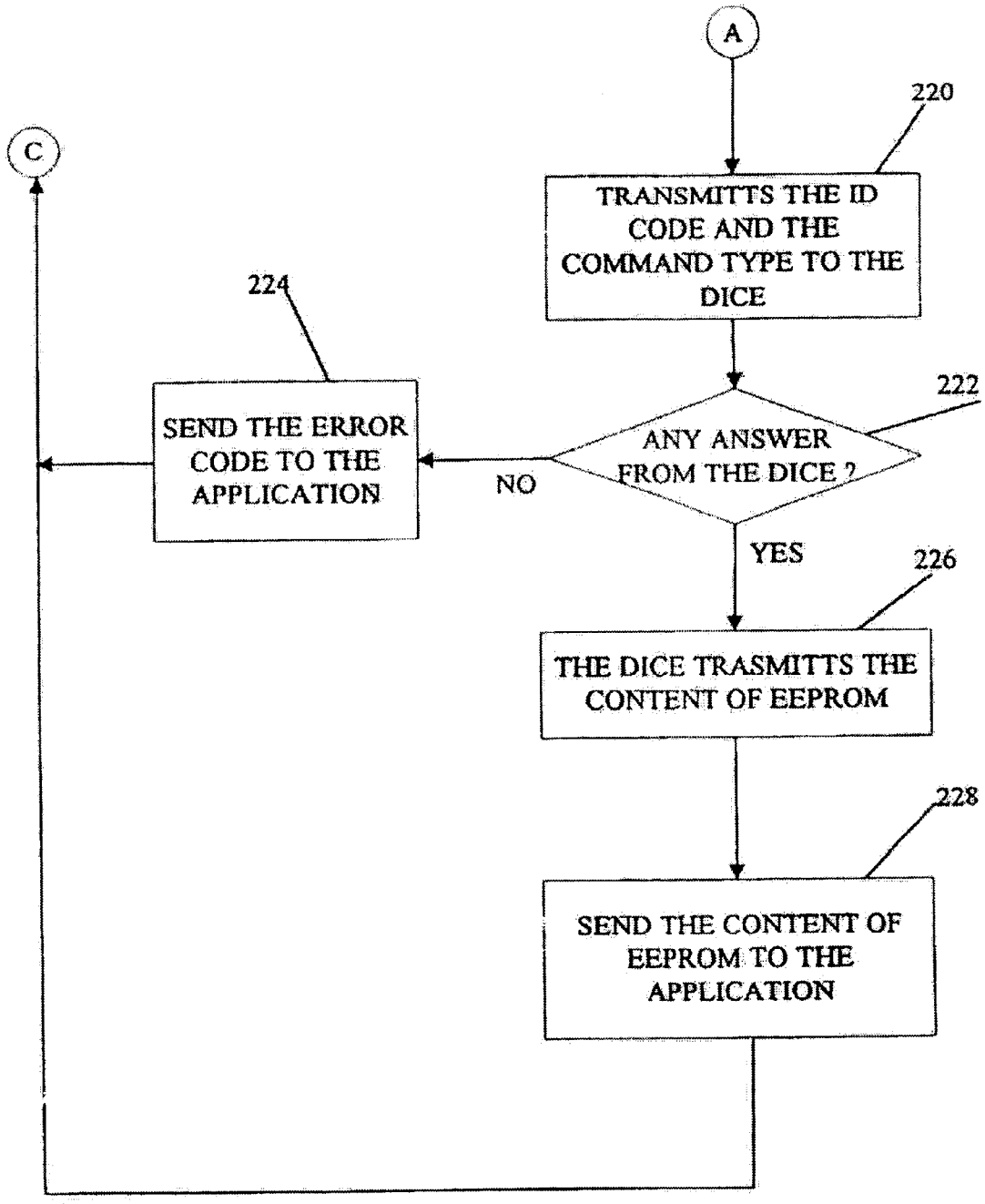

Referring to FIG. 5A, the calling application 200 sends an "ID code" and command type to the dice operating program (step 202). Depending on the specific command type, the computer performs the appropriate routine (stop 210). Two possible examples are illustrated; FIG. 5B which is a flow chart illustration for checking the authenticity of the dice and/or the software application (step 212) and FIGS. 5C–5D which is a flow chart illustration for checking the status of the dice (step 214).

It will be appreciated by persons knowledgeable in the art, that the type of read/write unit 14 utilized will be determined by the type of dice and the method of transmission. For instance, as in the preferred embodiment, the dice and the read/write unit 14 will be based on a similar RFID technology. Similarly, if the dice uses infra-red technology for transmission then the read/write unit 14 will of course be configured to receive infra-red technology.

A system utilizing the electronic dice 10 is described with reference to the flow charts of FIGS. 5A–5D, which describe the operational steps of a sample calling application 200.

Figure 5C:
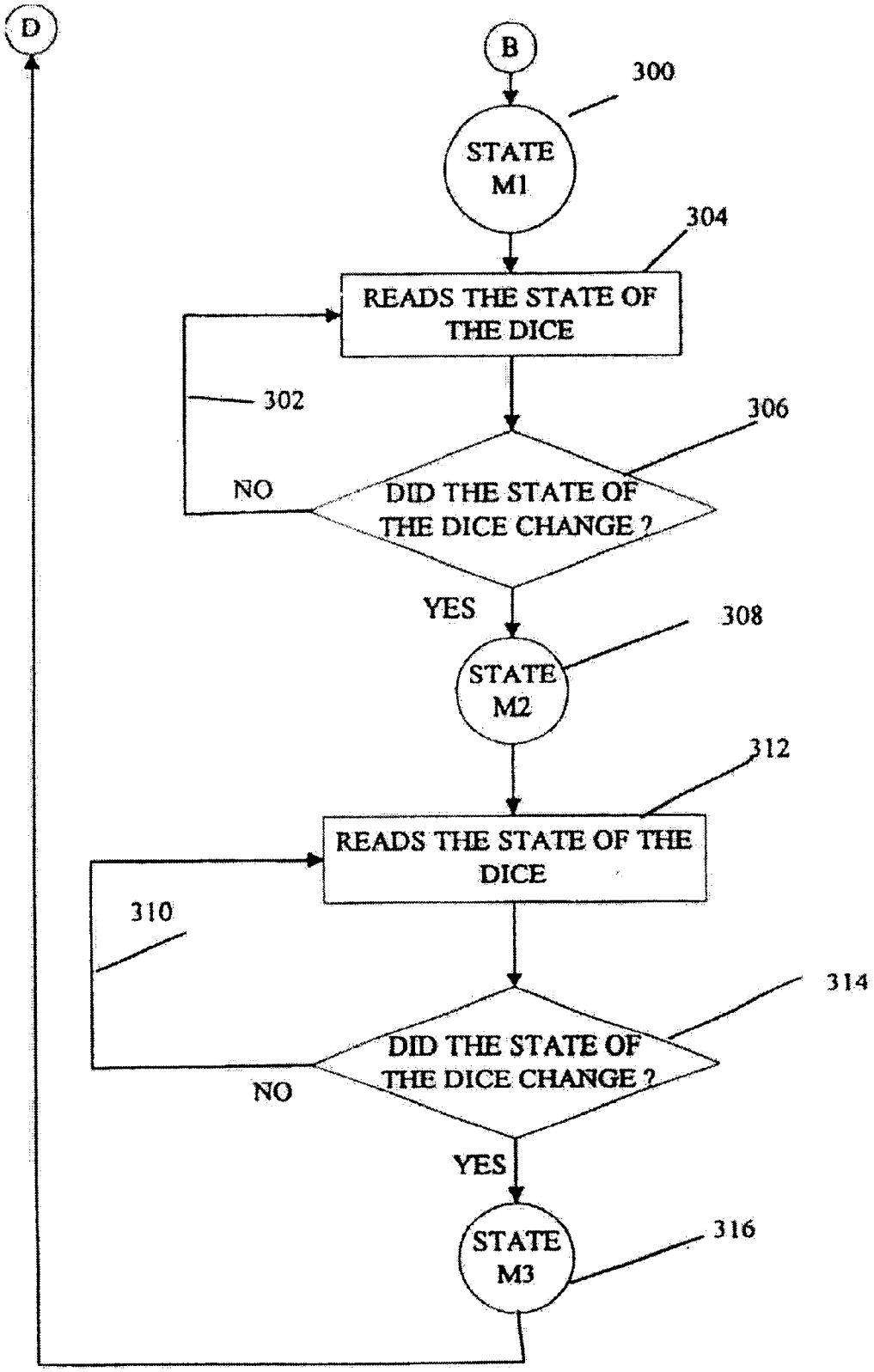
Figure 5D:
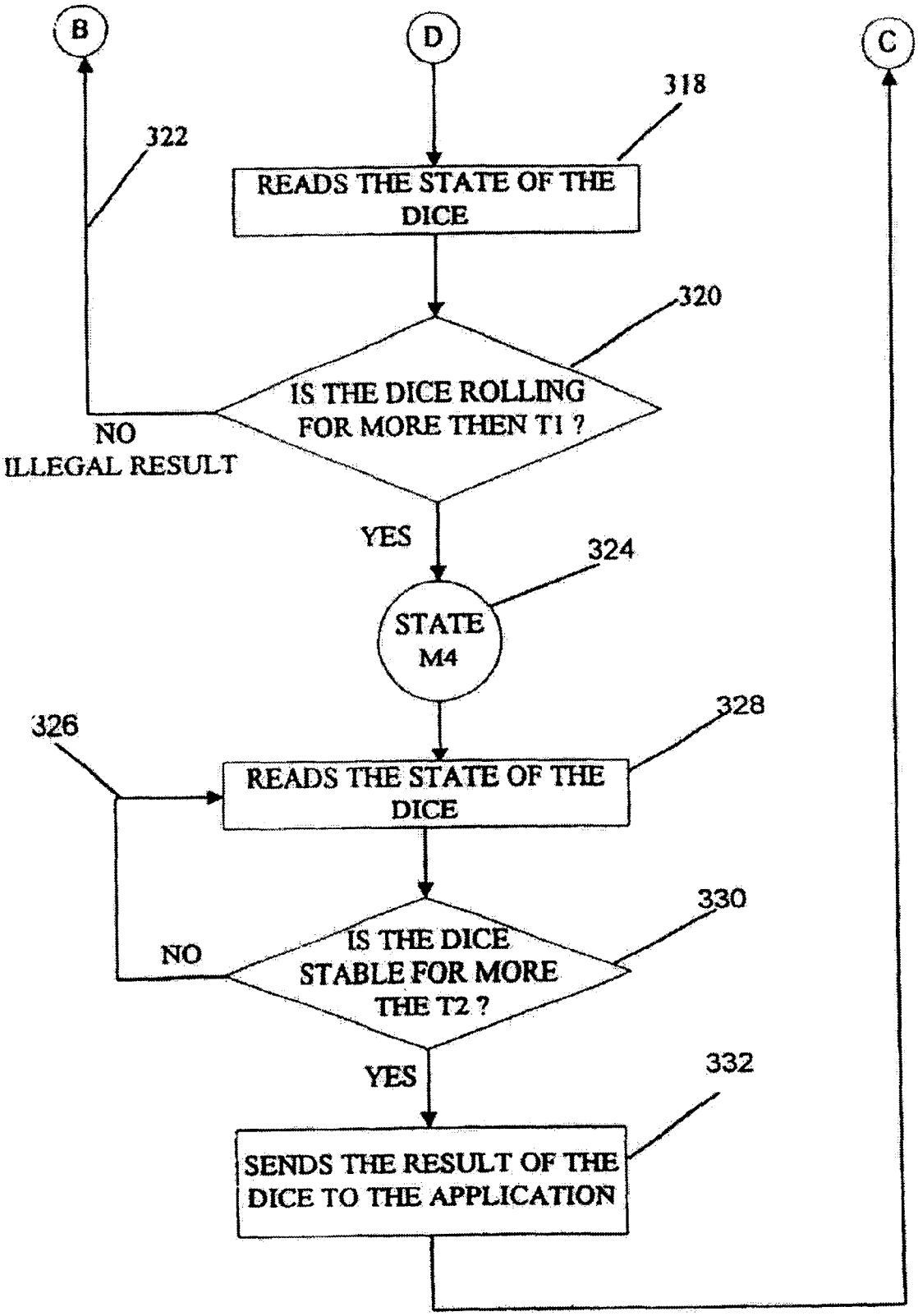

Reference is now made to FIGS. 5C–5D which is a flow chart illustration of the processing of data received from dice 10 (214). The dice 10 can exhibit one of four stages, as follows;

M1. The dice remains immobile for a predeternined time (ex. at least 1 sec);

M2. The dice is not lying on the playing surface (ex. being held by one of the players);

M3. The dice has been thrown on to the playing surface and is in motion, that is rolling on the surface for a predetermined time (t1, for example, between 0.5–1 secs); and M4. The dice has landed on the surface at least once and is now immobile on the surface for at least t2 secs.

While the dice is in state M1 (300), that is immobile, loop 302 is performed, that is the sensors S on the dice are read by read/write unit 14 (step 304), and the status of the dice is checked (query box 306) until there is a change to state M2 (308), that is, the dice has been lifted up, for example.

If the dice has been lifted off the surface and state M2 (308) is operative, loop 310 is performed. The dice is read again (step 312) and the state of the dice checked (step 314) to ascertain whether a change to state M3 (316) has occurred.

The dice program continually reads the state of dice 10 until there is a change to state M3 (316). If state M3 has occurred (316), that is, the dice has been thrown and is rolling on the playing surface, the status of the dice is checked as to whether state M3 still applies (step 318).

If the dice has been rolling for more than a prodetermined time of say t1 secs (query box 320), state M4 applies (324). Loop 326 is performed, that is the status of the dice is read again (step 328) to ascertain whether the dice is stable (query box 330). If status of the dice has not changed, that is, it has remained stable for more than t2 secs, the result of the dice throw is transmitted to the calling application (332). Control is then returned back to the calling application (200).

If, at stage 320, t1 secs has passed without the dice exhibiting rolling, an 'illegal' result is flagged and loop 322 is perfomled. That is, the application returns to state M1 (302) and steps 304–320 are repeated.

It will be appreciated by persons skilled in the art that the operational steps described hereinabove with respect to FIGS. 5A–5D, may be performed by the host computer 16 and/or other suitable microcontroller.

In the preferred embodiment of the invention the optical sensors place within each of the faces of the dice are coupled to the RFID tag in order to transmit the status of the dice to the reader.

It will be appreciated by persons skilled in the art that the present invention is not limited to the dice and type of sensors described in the above embodiments but may also include other types of sensors. For instance, in an altenative embodiment, an induction sensor cornprising a coil may be implanted into each face of the dice. In this case, the dice is thrown onto a metal board connected to an electric supply. The face of the dice falling onto the board induces a current thereby indicating the value of that face.

In a further alternative embodiment, a CCD (charge coupled device) camera is imbedded into the playing surface onto which the dice is thrown. A standard dice is used and the camera, which is coupled to a computer, photographs the face of the dice landing face down on the surface. The uppermost face of the dice can thus be determined. In a yet further altemative embodiment, a CCD or other digital type camera is positioned above the playing surface onto which the dice is thrown to photograph the topmost face of the dice. The camera is coupled to a computer for processing the resulting pictures.

It will be appreciated by persons skilled in the art that the operational steps described hereinabove with respect to FIGS. 5A–5D, may be performed by the host computer 16 and/or other suitable microcontroller.

Other known methods of software protection which use a hardware 'dongle' connected to a computer together with software to protect the application, have a disadvantage in that only a few (usually limited to two or three) "dongles" may be coupled to a computer at any one time. Thus, for a user having numerous different applications installed in his computer, each of which uses a "dongle", it is generally not a satisfactory solution to use them.

In contrast, since the electronic dice or object uses a wireless transmission system and is not connected to the computer, there is no limit to the number of protected applications which may be run at any time.

It will be further appreciated by persons skilled in the art that the present invention is not limited by what has been particularly shown and described herein above. Rather the scope of the invention is defined by the claims which follow:

What is claimed is:

1. A die having n faces, where n is greater than 2, each face being identifiable and comprising wireless transmitting means for transmitting data to identify at least which of the n faces is lying face down when the die is lying on a surface.

2. A die having n faces, where n is greater than 2, each face being identifiable and comprising:

a. at least n−1 sensors, each of n−1 faces of said die having one of said at least n−1 sensors installed therein;

b. a controller coupled to each of said at least n−1 sensors; and c. wireless transmitter device coupled to said controller, said wireless transmitter device transmitting data from at least one of said at least n−1 sensors to identify at least which of the n faces is lying face down when the die is lying on a surface.

3. A die according to claim 2, wherein said controller is a device selected from a group consisting of a register, processor, buffer control logic and micro-controller.

4. A die according to claim 2, wherein said wireless transmitter device is a device selected from a group consisting of an infra-red transmitter RF transceiver and an ultrasonic transmitter.

5. A die according to claim 2, wherein said wireless transmitter device is a transponder, said transponder comprising;

a radio frequency (RF) transceiver;

electrically erasable programmable read-only memory (EEPROM) storage means coupled to said radio frequency transceiver; and controller connected to said memory means and said RF transceiver.

6. A die according to claim 2, and wherein said controller is coupled to said RF transceiver for latching the signals being transmitted by each of said at least n−1 sensors at predetermined intervals.

7. A die according to claim 2, wherein the electrical components of said die receive their operating energy from a remote transceiving unit.

8. A die according to claim 2, wherein the electrical components of said die receive their operating energy from any of a group of power supplies including solar cells, dry-cell batteries, photo-voltaic cells coupled thereto.

9. A die according to claim 5, wherein said EEPROM storage means comprises an ID code and/or encrypted data stored therein.

10. A die according to claim 2, wherein said sensors comprise photodiode, photo-transistor sensors, mechanical sensors, capacitance sensors or induction coll sensors.

11. A die having n faces, where n is greater than 2, each face being identifiable, the die comprising at least n−1 transponders, installed therein for transmitting data to identify at least which of the n faces is lying face down when the die is lying on a surface.

12. A die according to claim 11, wherein said at least n−1 transponders comprise:

a radio frequency (RF) transceiver;

electrically erasable programmable read-only memory (EEPROM) storage means coupled to said radio frequency transceiver; and a controller, connected to said memory means and said RF transceiver.

13. A die according to claim 11, wherein said at least n−1 transponders receive their operating energy from a remote transceiving unit.

14. A die according claim 12, wherein at least one of said EEPROM storage means comprises an ID Code and/or encrypted data stored therein.

15. A system for communicating with at least one die, each die having n faces, where n is greater than 2, each face being identifiable, said system comprising:

a wireless transmitter device installed in said die, for transmitting data to identify at least which of the n faces is lying face down when the die is lying on a surface;

a read/write unit for receiving said transmitted data; and a processing unit coupled to said read/write unit, for processing said data.

16. A system according to claim 15, and wherein said read/write unit comprises:

a. a base station transceiver having at least one antenna;

b. a microcontroller or control logic coupled to said base station transceiver.

17. A system according to claim 15, wherein said processing unit is coupled to said read/write unit by means of a coupling comprising any of the following group including serial RS232, parallel, USB (Universal serial Bus) and SCSI (small computer system Interface) or keyboard interface.

18. A system according claim 15, wherein said die further comprises:

a. at least n−1 sensors, each of n−1 faces of said die having one of said at least n−1 sensors installed therein; and b. a controller coupled to each of said at least n−1 sensors; wherein said wireless transmitter device is coupled to said controller, said wireless transmitter device transmitting data from at least one of said at least n−1 sensors to identify at least which of the n faces is lying face down when the die is lying on a surface.

19. A system according to claim 18, wherein said controller is a device selected from a group consisting of a register, processor, buffer control logic and micro-controller.

20. A system according to claim 18, wherein said wireless transmitter device is a device selected from a group consisting of an infra-red transmitter, RF transmitter and an ultrasonic transmitter.

21. A system according to claim 18, wherein said wireless transmitter device comprises:

a radio frequency (RF) transceiver;

electrically erasable programmable read-only memory (EEPROM) storage means coupled to said radio frequency transceiver; and a controller connected to said memory means and said RF transceiver.

22. A system according to claim 18, wherein said controller is coupled to said RF transceiver for registering the signals being transmitted by each of said at least n−1 sensors at predetermined intervals.

23. A system according to claim 18, wherein said electrical components of said die receive their operating energy from a remote read/write unit.

24. A system according to claim 18, wherein said electrical component of said die receive their operating energy from any of a group of power supplies including solar cells, dry-cell batteries, photo-voltaic cells coupled thereto.

25. A system according to claim 21, wherein said EEPROM storage means comprises a ID code and/or encrypted data stored therein.

26. A system according to claim 18, wherein said at least one sensors comprise photodiode, photo-transistor sensors, mechanical sensor capacitance sensor or induction coil sensors.

27. A system according to claim 15, wherein said die comprises:

n faces, where n is greater than 2, each face being identifiable; and at least n−1 transponders, each of n−1 faces of said die having one of said at least n−1 transponders installed therein for transmitting data to identify which of the n faces is lying face down when the die is lying on a surface.

28. A system according to claim 27, wherein said at least n−1 transponders comprise:

a radio frequency (RF) transceiver;

electrically erasable programmable read-only memory (EEPROM) storage means coupled to said radio frequency transceiver; and a controller, connected to said memory means and said RF transceiver.

29. A system according to claim 27, wherein said at least n−1 transponders receive their operating energy from a remote transceiving unit.

30. A system according to claims 28, wherein at least one of said EEPROM storage means comprises a ID code and/or encrypted data stored therein.

31. A system according to claim 15, and further comprising a playing surface for throwing said die thereon.

32. A system according to claim 31, wherein said playing surface comprises sealing means to prevent light from reaching the face of said die in contact with said surface.

33. A system according to claim 31, wherein said playing surface is composed of a metallic material.

34. A system for identifying a die having n faces, where n is greater than 2, each face being identifiable, said system comprising:

a CCD (charge coupled camera) for imaging at least one face of said die; and a processing unit coupled to said CCD, for processing said image to identify the uppermost or lowermost face of the die.

35. A system according to claim 34, further comprising transmitting means and wherein said processing unit processes the CCD image for onward transmission.

36. Apparatus for a software driven application comprising:

c. at least one die, each of said at least one die having n faces, where n is greater than 2, each face being identifiable an having an ID code encrypted therein and comprising a wireless transceiver for transmitting data to identify at least which of the n faces is lying face down when the die is lying on a surface; and d. a software application for verifying the authenticity of said encrypted ID code for each of said at least one die in order to run the software application.

37. Apparatus according to claim 36 wherein said die is an integral component of said software application.

38. A method for identifying which of the faces of A die is laying on a surface, each face of the die being identifiable, said method comprising the steps of:

said at least one n-sided die transmitting data from at least the uppermost or lowermost face of said die and;

processing said data.

39. A method according to claim 38 and wherein said die comprises an ID code encrypted therein and a wireless transponder, and further comprising the step of a read/write transmitting a coded identification signal to said die to decrypt said encrypted ID code.

40. A method for protecting a plurality of software applications running in a multi-tasking environment, said method comprising:

storing data associated with each of said plurality of software applications in each of a plurality of dice, each of said plurality of dice having an ID code encrypted therein and having n faces, where n>2, each face being identifiable and comprising wireless transmitting means for transmitting data to identify at least which of the n faces is lying face down when the die is lying on a surface, said software applications verifying the ID code of the die;

transmitting data from each of said plurality of dice to said software applications; and verifying the authenticity of said transmitted data in order to run each of said plurality of software applications.

* * * * *